United States Patent [19]

Rizza

[11] Patent Number: 4,882,890

[45] Date of Patent: Nov. 28, 1989

[54] METHOD AND APPARATUS FOR SEALING EXPANDABLE ROOF JOINTS WITH OPTICAL INSULATION

[76] Inventor: Michael C. Rizza, 2863 Encina Camino, Walnut Creek, Calif. 94598.

[21] Appl. No.: 199,988

[22] Filed: May 27, 1988

[51] Int. Cl.[4] ..... E04B 1/62

[52] U.S. Cl. ..... 52/396; 52/395; 52/58; 52/464

[58] Field of Search ..... 52/58, 395, 396, 464, 52/468, 471; 404/47, 67, 68, 69

[56] References Cited

U.S. PATENT DOCUMENTS

| | | | |
|---|---|---|---|
| 1,357,713 | 11/1920 | Lane . | |
| 2,029,817 | 2/1936 | Fegles . | |
| 3,300,913 | 1/1967 | Patry et al. | 52/58 |
| 3,425,172 | 2/1969 | Attaway | 52/395 A |
| 3,659,390 | 5/1972 | Balzer et al. . | |
| 3,724,155 | 4/1973 | Reeve . | |
| 3,750,359 | 8/1973 | Balzer et al. . | |
| 3,838,931 | 10/1974 | Valla . | |
| 3,849,958 | 11/1974 | Balzer et al. . | |
| 4,007,994 | 2/1977 | Brown . | |
| 4,111,584 | 9/1978 | Fyfe . | |
| 4,129,967 | 12/1978 | Barlow . | |

*Primary Examiner*—David A. Scherbel
*Assistant Examiner*—Creighton Smith
*Attorney, Agent, or Firm*—Townsend and Townsend

[57] ABSTRACT

A weather seal for expandable roof joints or roof-to-wall joints is provided with an elastomeric outer seal, retaining means for receiving flashing or portions of the building structure, and further for receiving a clamping bar and continuously applied sealant material. The weather seal is further provided with means for retaining insulation/support material against the inner surface of the elastomeric outer seal. An inner membrane, or gutter member, may be positioned within the joint and affixed to the structure sections between the elastomeric outer seal to provide improved imperviousness of the weather seal. Flashing material may be appropriately shaped to receive portions of the weather seal for securing the weather seal in place of the clamping bar.

17 Claims, 4 Drawing Sheets

METHOD AND APPARATUS FOR SEALING EXPANDABLE ROOF JOINTS WITH OPTICAL INSULATION

BACKGROUND OF THE INVENTION

1. Field of the Invention

The present invention relates generally to weather seals, and more particularly to weather seals used to protect areas between adjacent building surfaces from moisture and foreign materials at roof lines or where a roof surface meets a wall surface, such that independent movement of each building surface is allowed while an impervious seal is maintained.

2. Description of the Relevant Art

When building large structures, especially of concrete or similar material, it is often necessary to build the structure in sections leaving gaps, called joints, between the sections to allow for thermal expansion and contraction of the building material. Likewise, when structures are built in close proximity to one another, it is often necessary to make allowance, by means of a joint, for relative motion between the adjacent structure sections caused by seismic activity. climatic conditions (e.g., wind) and thermal expansion and contraction of the structures. Joints allow the adjacent structure sections to move freely relative to one another, and thus allow distribution of motion, expansion, or contraction between several structure sections.

When a joint is provided between adjacent structure sections, steps must be taken to isolate the inner region of the joint, between the structure sections, from the external environment. It is especially important to seal the inner region against entry of water, dirt, and other foreign material which may affect heating, ventilation, electrical interconnection, interior fixtures, and the ability of each adjacent structure section to move relatively independently. To facilitate this isolation, one or more of a wide variety seals may be used. A requirement of any seal used in such applications is that it be capable of expanding and contracting with the width of the joint in order to accommodate motion of the structure sections while maintaining its imperviousness.

One location such seals are commonly used is at the joint where the roof line of one structure meets the roof line of a second structure. A variation of this is the use of such seals at the joint where the roof line of one structure meets a wall of a second structure. Sealing of joints at these locations is typically accomplished by extending across the joint a flexible or elastomeric material which is secured to each of the structures.

Providing seals of improved imperviousness to moisture, dust, etc., is the subject of a number of patents, for example those issued to Lane, U.S. Pat. No. 1,357,713, issued Nov. 2, 1920, and to Reeve, U.S. Pat. No 3,724,155, issued Apr. 3, 1973. The seals of the prior art share several common problems, including inadequate mating of seal and building surface, inability of the seal to be used at either roof-to-roof or roof-to-wall joints, inability to provide adequate insulation of the joint, inadequate seal support (especially where one seal section joins a second seal section), inability to manufacture the seal in continuous lengths and inability to easily store and transport large continuous sections of the seal prior to and during its installation. The seal of the present invention overcomes these problems, and others, as described in detail below.

SUMMARY OF THE INVENTION

The invention herein disclosed provides an improved weather seal which isolates the inner region of a building joint from the external environment. The weather seal may be used at roof lines of adjacent structures, or may be used where the roof line of a first structure meets a wall of a second structure. The seal may be manufactured in continuous lengths and may easily be rolled for storing and transporting prior to and during its application.

In one embodiment of the present invention, a weather seal is provided comprising a continuous elastomeric outer seal member having two overlapping flaps at each of its edges which are capable of receiving flashing secured to the structure surfaces or sections of the structure surfaces themselves. The inner area between each pair of overlapping flaps is provided with a region for receiving a clamping bar or clamping beam to provide improved engagement between the seal and the structure surfaces. The inner area between overlapping flaps is further provided with a region to receive a continuous caulking material to improve the imperviousness of the seal.

In another embodiment of the present invention, a weather seal is provided with an inner seal member, or gutter located within the joint and secured at its edges to the outer seal member to provide improved imperviousness of the seal. The gutter is of elastomeric composition to allow for relative motion between structure surfaces.

In yet another embodiment of the present invention, a weather seal is provided having means for retaining insulation material and/or support material between the outer seal member and the joint. The retaining means may either be secured to the weather seal or may be integrally formed therewith. Insulation material may then be used to prevent unwanted heat loss or heat entry between the inner region of the joint and the external environment. This insulation material may also be used to provide support for the outer seal member to help prevent the outer seal member from sagging into the joint. Likewise support material may be secured to the weather seal by the retaining means to help prevent the outer seal member from sagging into the joint.

In another embodiment of the present invention, metal flashing or portions of the building structure are shaped to receive an appropriately shaped flange on the weather seal. The flashing or portions of the building structure provide both secure attachment of the weather seal to the building structure and an additional degree of imperviousness to weather conditions. An additional advantage of this embodiment is that the shape of the flashing or building structure receiving the weather seal allows for quick and simple installation, removal and replacement of the weather seal.

To facilitate a better understanding of the present invention a detailed description with reference to the accompanying drawings follows. With regard to the following detailed description and drawings, it should be noted that like reference numerals denote like elements in different figures.

DETAILED DESCRIPTION OF THE PREFERRED EMBODIMENT

Figure 1:
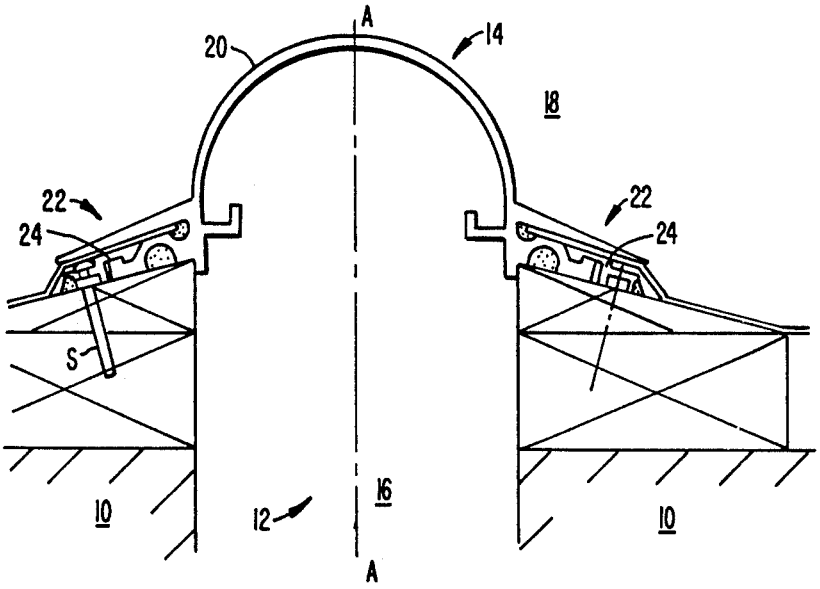
FIG. 1 is a cross-sectional view of a weather seal according to one embodiment of the present invention, located across a joint at roof lines of two adjacent building structures looking along the longitudinal axis of the seal.

As illustrated in the embodiment shown FIG. 1, the weather seal according to the present invention is useable in a structural joint at the roof lines of two adjacent building structures each represented by the reference numeral 10 which may be sections of the same structure or different structures. The details of the building structures themselves are omitted for clarity in the description of the present invention. It should be noted, however, that the present invention will be equally applicable with a wide variety of building structure configurations and the precise building structure configuration forms no part of the present invention.

As illustrated, a joint 12 is defined between adjacent building structures 10. The joint is spanned by weather seal 14 according to the present invention which isolates the inner region 16 of joint 12 from the external environment 18. Weather seal 14 has an outer seal member 20 of an elastomeric material spanning joint 12 and a pair of securing means generally designated by reference numeral 22 which attach to building structures 10. Weather seal 14 is formed of a continuous length so as to extend continuously the length of the joint in conventional applications, although it may be formed or cut to any length as particular circumstances dictate. In use, outer seal member 20 assumes an arch-shape cross section to best keep the seal from sagging into the joint (further as described below optional insulation/support material may be used to help keep the seal from sagging).

Figure 2:
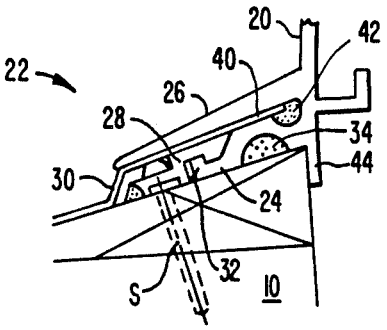
FIG. 2 is a detailed cross-sectional view of securing means of a weather seal according to one embodiment of the present invention.

FIG. 2 shows in detail one embodiment of securing means 22. Only one of the pair of securing means 22 is shown in FIG. 2, and described below as in this embodiment each is a mirror image of the other. Securing means 22 has two flap members, lower flap member 24 and upper flap member 26, which extend at an angle (which may be varied) away from the vertical axis A—A so as to generally follow the sloping course of the roof lines of structures 10. Lower and upper flap members 24 and 26 are sized and positioned to receive a clamping bar 28 (secured to building structures 10 by screw S, as shown in phantom or by other similar fastening device) therebetween. Lower and upper flap members 24 and 26 are further sized and positioned to receive flashing material 30 which is secured to building structures 10 (or, equivalently, a portion of building structure 10 itself), therebetween.

In order that weather seal 14 be more securely attached to building structures 10 lower flap member 24 is provided with an L-shaped region 32 for engaging clamping bar 28 at an edge farthest from where outer seal member 20 meets securing means 22. The upwardly extending portion of L-shaped section 32 engages a correspondingly shaped recess in clamping bar 28 when the seal is installed. The portion of L-shaped region 32 extending at 90 degrees to the upwardly extending portion is, in essence, pinched between clamping bar 28 and building structure 10. In this way, lower flap member 24 and clamping bar 28 may work together to securely attach weather seal 14 to building structures 10. It should be appreciated that the correspondence between weather seal 12 and clamping bar 28 may be other appropriate configurations serving the desired function of a clamped attachment of weather seal 14 to structures 10.

Lower flap member 24 further includes an arched section defining a first cavity 34 between itself and building structure 10. This first cavity may serve multiple purposes depending upon the particular embodiment of weather seal 14 being used. For example, in the case where weather seal 14 is used in conjunction with a continuous elastomeric gutter 36 (shown in FIG. 4 and described in further detail below), first cavity 34 will receive a securing rib 38 (also shown in FIG. 4, and described in further detail below) to secure gutter 36 in place. In the case where gutter 36 is not used, first cavity 34 may be used to receive a continuously applied sealant material, for example one of a variety of caulking materials to help prevent entry of dirt, moisture, etc., into the joint through the area between lower flap member 24 and structure 10.

Lower flap member 24 secures to upper flap member 26 at the edge of securing means 22 closest to where outer seal member 20 meets securing means 22 and overlap one another to define a region 40 for receiving flashing material 30. At the point at which lower and upper flap members 24 and 26 meet, a second cavity 42 is defined for receiving continuously applied sealant material, for example one of a variety of caulking materials to improve the imperiousness of weather seal 14.

As demonstrated by FIG. 2, flashing material 30 bends upward above clamping bar 28 and extends above clamping bar 28 and lower flap member 24 in region 40 into second cavity 42. Upper flap member 26, which is basically a flat section of elastomeric material, is positioned and sized to lay flat atop flashing material 30 to, in essence, pinch flashing material 30 between itself and lower flap member 24. The surface contact between upper flap member 26 and flashing material 30 provides an added degree of imperviousness to weather seal 14 and flashing material 30 extending into second cavity 42 provides a further degree of imperviousness to weather seal 14

In order to facilitate alignment of weather seal 14 across joint 12, each lateral edge of weather seal 14 is provided with an alignment leg 44 affixed to securing means 22 ar a position below securing means 22 which extends in a direction away from outer seal member 20. When weather seal 14 is used with gutter 36 (shown in FIG. 4), proper alignment of weather seal 14 relative to joint 12 is assured when alignment leg 44 is flush against gutter 36 which in turn, is flush against the wall region of building structure 10 within joint 12. When weather seal 14 is not used with gutter 36 proper alignment of weather seal 14 relative to joint 12 is assured when alignment leg 44 is flush against the wall section of building structure 10 within joint 12.

It should be noted from the above description that a secure attachment of weather seal 14 to building structures 10 is achieved without piercing or puncturing of the weather seal. This represents a marked improvement over prior art weather seals. In appropriate circumstances, however, it may be desirable to pass a nail screw or other fastening means directly through lower flap member 24, for example in circumstances where there is great pressure on the weather seal tending to pull it away from the building structure. In such cases, the alternate embodiment of the present invention shown in FIG. 3 may be desirable.

Figure 3:
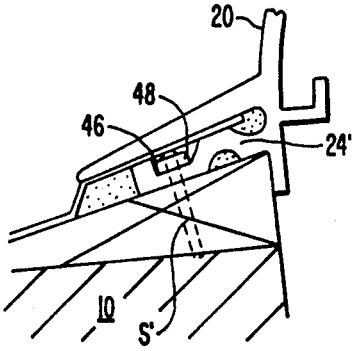
FIG. 3 is a detailed cross-sectional view of securing means of a weather seal according to an alternate embodiment of the present invention.

The embodiment illustrated in FIG. 3 is similar in many respects to that described above. One key difference between the two is the extending of the L-shaped region 32 of FIG. 2 to form rectangular recess 46 in lower flap member 24' of FIG. 3 for receiving a camping beam 4B of rectangular cross section. In this embodiment a screw, pin or other fastening means S' (shown in phantom in FIG. 3) is introduced through clamping beam 48 and lower flap member 24 and engages building structure 10. Clamping beam 48 may be predrilled to accommodate fastening means S or it may be of a sufficiently soft material to allow introduction of fastening means S' therethrough without predrilling.

Figure 4:
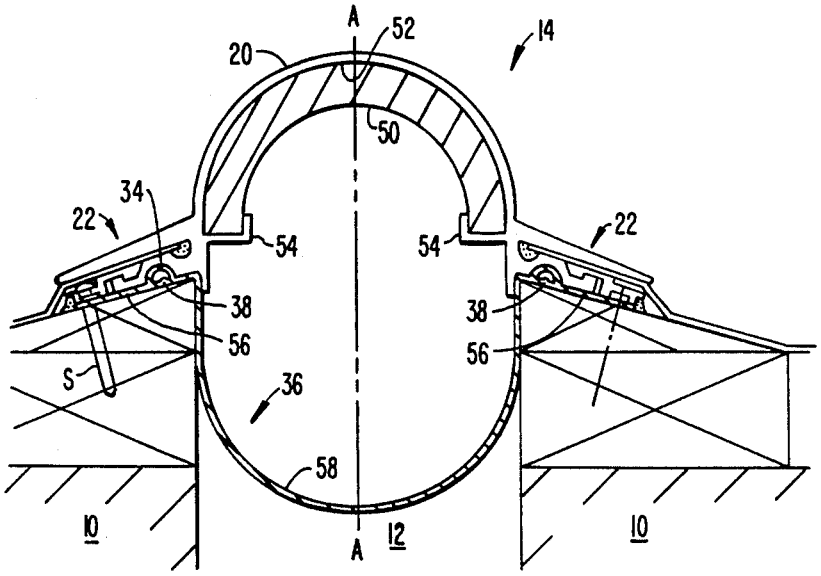
FIG. 4 is a cross-sectional view of a weather seal according to one embodiment of the present invention located across a joint at roof lines of two adjacent building structures looking along the longitudinal axis of the seal having both a gutter member and insulation/support material secured to the weather seal.

It is often desirable to provide insulation and/or supporting material inside the weather seal. Means for securing such insulation and/or supporting material to weather seal 14 and providing such is illustrated in FIG. 4. The provision of insulation material would improve the thermal isolation between the joint and the external environment. Because the joint may be linked to or part of the open internal portion of the structure(s), thermal isolation between the joint and the external environment would provide thermal isolation between the internal portion of the structure(s) and the external environment. This may result in reduction of heating and/or air conditioning costs protection of structural elements that are temperature sensitive, etc.

Additionally, supporting material may be provided between joint 12 and weather seal 14 to improve the shape-holding quality of the weather seal. The maintaining of the cross-sectional shape is an important measure against leakage and/or collapse of the seal into the joint. For example, if standing water or snow was allowed to collect on top of the weather seal, its weight could potentially pull a side of the weather seal out of engagement with its corresponding building surface thus destroying the effectiveness of the seal. If a cross-sectional shape of weather seal 14 is maintained such that standing water or snow is prevented from accumulating on the seal the risk of leakage or seal collapse into the joint is reduced.

It is quite feasible that a single material may serve the dual functions of insulation and support discussed above, and in fact is most likely the case. Materials such as a dense closed-cell foam or neopreme would function suitably well in such applications, although other materials may be used with equivalent results.

Figure 5:
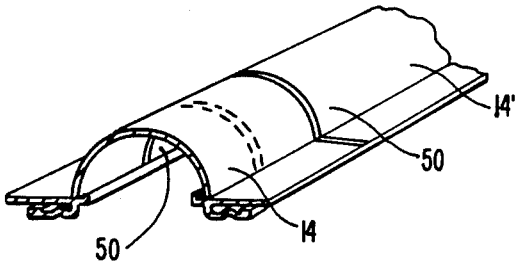
FIG. 5 is a perspective view of two sections of a weather seal joined with a joining/insulation material.

An additional function which the insulation/support material may serve is as a connector where two sections of weather seal adjoin one another. For example, if one section of weather seal 14 is to be coaxially joined with another section of weather seal 14 a connector may be located on the inside surface of each section and to which each section may be secured to prevent leaks and separation where the sections meet. FIG. 5 shows a perspective view of two sections of weather seal 14 and 14' which are joined with material 50 added to support the joint and give a surface to which sections 14 and 14' may be attached.

In the embodiment of the present invention shown in FIG. 4 the outer seal member 20 and securing means 22 are unchanged from that described above. It is advantageous in positioning insulation/support material 50 to locate it against the inner wall 52 of outer seal member 20 so that insulation/support material 50 may function most effectively as support means to assist in preventing outer seal member 20 from sagging into joint 12, as discussed above.

An L-shaped retaining web 54 is provided on the inside surface of each side of weather seal 14 extending first horizontally toward the center of joint 12 (axis A—A). then vertically upward toward outer seal member 20 to retain the insulation/support material 50. Insulation/support material 50 may be installed such that its lateral edges are positioned against the horizontal extension of retaining web 54 and such that it is held against inner wall 52 of outer seal member 20 by the vertical extension of retaining web 54. Therefore, the length of horizontal extension of retaining member 54 will approximately match the thickness of insulation/support material 50 expected to be secured thereby and the length of the vertical extension of retaining member 54 will be at least sufficient to hold a portion of insulation/-support material 50 against inner wall 52.

As discussed, one role of the material is to provide support for outer seal member 20. Thus, a firm material is desirable. However, the material must be flexible enough to withstand expansion and compression so as to accommodate motion of the joint without becoming disengaged from retaining web 54. It may also be desirable to further secure insulation/support material 50 to inner wall 52 by the selected application of adhesive material (not shown) to prevent disengagement of insulation/support material 50.

The above description has assumed for clarity of description only that outer seal member 20 securing means 22 aligning leg 44 and retaining web 54 were manufactured as discrete components each secured together in the above-mentioned order. This is one option for the manufacture of a weather strip according to the present invention. More commonly, however, each element of the weather strip 14 would be integrally formed together. In fact, any combination of elements may be integrally formed together then secured to other elements. By way of example only, outer seal member 20 may be integrally extruded with securing means 22 and aligning leg 44 and retaining web 54 may thereafter be secured in its appropriate position. Similarly, any of those elements integrally formed together may be removed when appropriate. In this way a versatile weather seal is provided which is capable of being adapted to a wide variety of applications.

It is the reality of such devices that no seal is perfect—some leakage is going to occur. To aid in the prevention of the errant moisture, dirt, etc., that leaks through the seal from contaminating the joint, a gutter 36 shown in FIG. 4 is provided in one embodiment of the present weather seal, which is located within the interior of joint 12 when weather seal 14 is installed which collects the leakage.

Gutter 36 is preferably continuous, extending the length of the joint. Gutter 36 consists of flat sections 56 at its lateral edges. Protruding from each flat section 56 is a securing rib 38 for securely engaging first cavity 34 (as described above with reference to FIG. 2). Each securing rib 38 is continuous along the length of gutter 36 to provide optimum connection to weather seal 14. Gutter 36 further consists of channel section 58 connecting flat sections 56. Channel section 58 and preferably each section of gutter 36 is of an elastomeric material capable of expanding and compressing to accommodate motion of structure sections 10.

Gutter 36 is secured in place such that flat sections 58 lie between structure sections 10 and securing means 22. Fastening means S (or S' in appropriate applications) may extend through flat sections 58 to provide better securing of gutter 36 in place, where such is desired. Securing rib 38 is securely engaged into first cavity 34. This engagement provides the dual functions of improving the imperviousness of the seal to leakage and of securing gutter 36 in its proper place. Channel section 58 is then located into the joint at an appropriate depth to allow expansion of the joint. As noted above, proper placement of gutter 36 is aided by alignment legs 44 (described above with reference to FIG. 2). The matter collected in gutter 36 may be drained by way of drain spouts or openings at selected locations along the seal length, for example, at the seal's terminus at the end of the joint.

Figure 6:
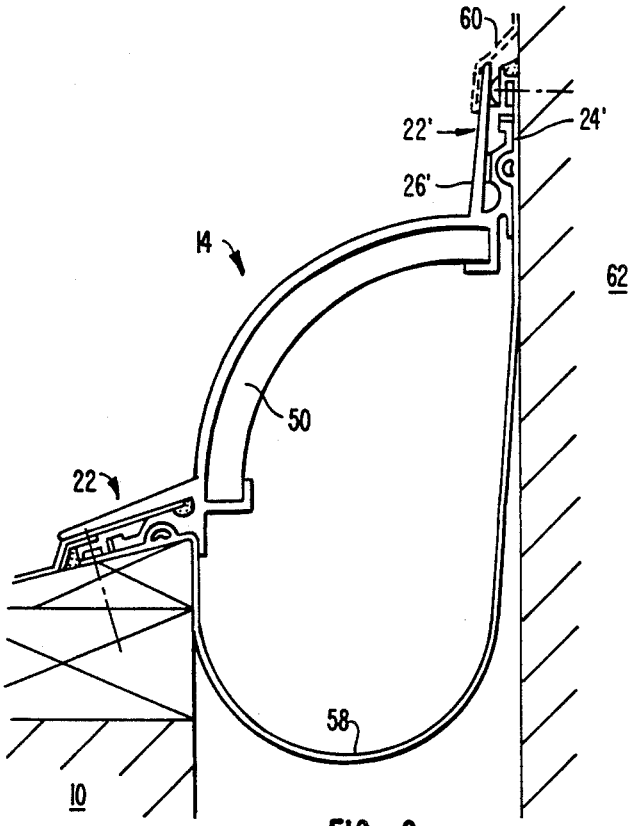
FIG. 6 is a cross-sectional view of a weather seal according to a further embodiment of the present invention, located between first and second adjacent structure sections where the roof line of the first structure section meets a wall of the second section having both a gutter member and insulation/support material secured to the weather seal.

The weather seal according to the present invention may be positioned at joints where roof lines of the adjacent structure sections meet or where the roof line of one structure section meets a wall surface of an adjacent structure section. This latter case is illustrated in FIG. 6. The primary difference between the embodiment shown in FIG. 6 and the above descriptions is the use of flashing cover 60 at wall surface 62. Such a flashing cover 60 is well known in the art and is described only briefly herein to aid in illustrating the application of the present invention.

Where weather seal 14 attaches to wall surface 62, attachment of weather seal 14 to the structure surfaces is essentially as described above except that securing means 22' may be nearly or actually vertical. In this position moisture, dirt, etc., falling under the influence of gravity, wind, etc., would tend to settle into securing means 22' between lower flap member 24' and upper flap member 26' thus making more likely the possibility that leakage could occur. Therefore. flashing cover 60 is used to cover the opening between lower flap member 24' and upper flap member 26' to prevent such contamination. This is as opposed to flashing material 30 being resident within securing means 22, as previously described, which would be susceptible to leakage as discussed above described.

In the roof line-to-wall configuration any of the aforementioned elements including insulation/support material 50 and gutter 58 may be included. The flexibility of the material used, the relative placement of the elements and the secure attachment of the elements to the structure sections allows versatility of placement and application of the weather seal according to the present invention.

Figure 7A:
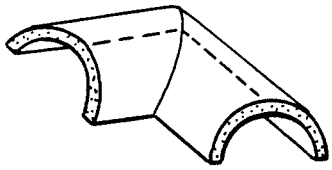
FIGS. 7*a, b, c* and *d* show a variety of splices and transition pieces used to join sections of weather seals to other sections of Weather seals or to structure sections.
Figure 7B:
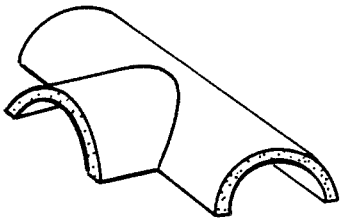
Figure 7C:
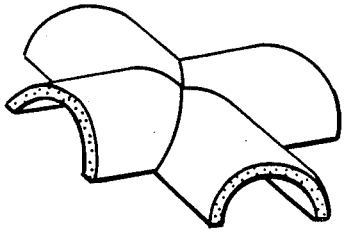
Figure 7D:
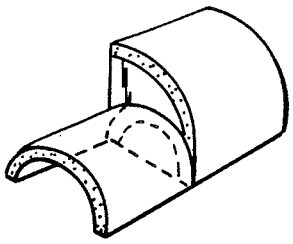

To aid in the connection of a section of weather seal 14 to other sections of weather seal 14, or to various types of structure surfaces, a variety of splices and transition pieces may be utilized. Examples of such splices and transition pieces are shown in FIGS. 7*a, b, c* and *d* as a corner, tee, cross, and roof-to-wall/wall-to-roof transition, respectively. Those splices and transition pieces shown in FIGS. 7*a, b, c* and *d* are representative of such elements and in no sense is that set of Figs. exhaustive of the possible connections.

Figure 8A:
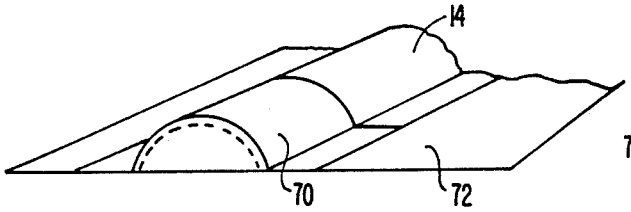
FIGS. 8*a* and *b* show end caps for roof-to-roof and roof-to-wall applications respectively.
Figure 8B:
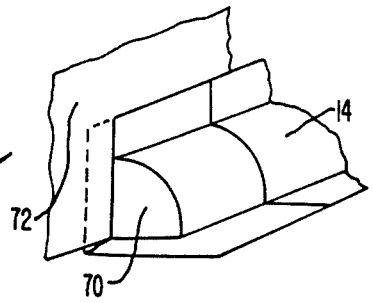

Further, when a section of weather seal 14 terminates, it may terminate at a wall be joined in a continuous circuit with itself or be capped. When weather seal 14 is to be capped, an uncured neoprene end cap 70 may be placed over the end of weather seal 14 and flashing material 72 placed over top selected sections of the end cap as would be well known to one skilled in the art (see FIGS. 8*a* and 8*b*).

Figure 9A:
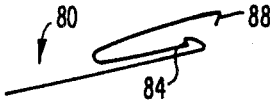
FIG. 9*a* is a cross-sectional view of a securing means for securing the weather seal according to a further embodiment of the present invention.
Figure 9B:
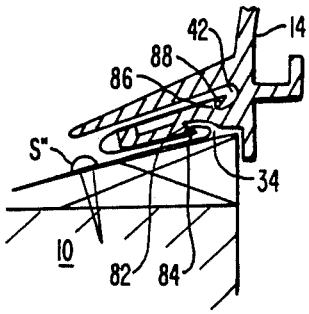
FIG. 9*b* is a cross-sectional view of a weather seal attached to a structure utilizing the securing means of the embodiment shown in FIG. 9*a;*

In certain applications it is desirable to shape the flashing material or the structure sections so that lower flap member 24 may be quickly and securely attached thereto without need for use of a clamping bar. An example of an embodiment employing this concept is shown in FIGS. 9*a* and *b*. FIG. 9*a* shows a section of flashing material 80 used to retain seal 14 in such an embodiment. Described in conjunction with FIG. 9*b* flashing material 80 is secured by appropriate securing means S'' to structure 10. First cavity 34 of weather seal 14 acts as a receiving means and is provided with a flat, inclined surface 82 which is designed to receive a corresponding flat inclined surface 84 on flashing 80 which acts as a retaining clip to retain the weather seal. Similarly, second cavity 42 of weather seal 14 acts as a receiving means and is provided with a flat inclined surface 86 which is designed to receive a corresponding flat, inclined surface 88 on flashing 80 which acts as a retaining clip to retain the weather seal.

In application, lower flap member 24 is inserted into the preshaped flashing 80 such that flat inclined surface 82 engages flat inclined surface 84, and flat inclined surface 86 engages flat inclined surface 88. As before, upper flap member 26 resides atop flashing 80 and lower flap member 24 to provide protection from entry of moisture, dirt, etc.

It should be noted that even in those embodiments where first cavity 34 receives flashing or portions of the structure first cavity 34 may also still receive continuously applied sealant material to provide a better more impervious seal. The same is true with regard to second cavity 42; i.e., that it may receive both flashing or structure sections and continuous sealant material for an improved seal.

Figure 10A:
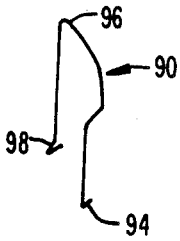
FIG. 10*a* is a cross-sectional view of a securing means for securing the weather seal according to yet a further embodiment of the present invention.

FIGS. 10*a* and *b* show a similar arrangement to that shown in FIGS. 9*a* and *b*, except that the joint in FIGS.

Figure 10B:
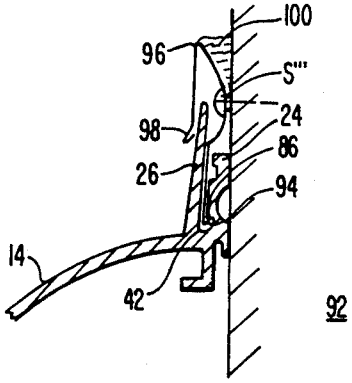
FIG. 10*b* is a cross-sectional view of a weather seal attached to a structure utilizing the securing means of the embodiment shown in FIG. 10*a.*

10*a* and *b* is a roof-to-wall joint. Again, it is desirable, in certain applications to shape the flashing material or the structure sections so that the lower flap member 24 may be quickly and securely attached thereto without need for use of a clamping bar. FIG. 10*a* shows a section of flashing material 90 used to retain seal 14 at roof-to-wall joints. Described in conjunction with FIG. 10*b*. flashing material 90 is secured by appropriate securing means S''' to wall structure 92. Second cavity 42 of weather seal 14 is provided with a flat, inclined surface 86 which is designed to receive a corresponding flat inclined surface 94 or flashing 90. Further, flashing 90 is provided with an arched-shaped upper hood region 96 which is appropriately shaped to receive and enclose upper flap member 26. Upper hood region g6 terminates in a lip g8 which serves to direct water, dirt, etc. away from the region between lower flap member 24 and upper flap member 26 and away from the region between lower flap member 24 and wall structure 92. Lip 98 also helps direct upper flap member 26 into position in upper hood region 96 during installation.

In application lower flap member 24 is inserted into preshaped flashing 90 such that flat, inclined surface 86 of lower flap member 24 engages flat inclined surface g4 on flashing 90. Upper flap member 26 is inserted into upper hood region 96, guided by lip 98. Sealant material 100 may be applied between upper hood region 96 and wall structure 92 to provide an impervious seal between the flashing 90 and wall surface 92. Sealant material 100 may be silcone-based material, caulking, or other appropriate material as the particular application dictates.

To provide an improved seal between the joint and external environment, sealant material may be placed in first cavity 34 between lower flap member 24 and wall surface 92. Further, sealant may be placed in second cavity 42 before or after placing flat, inclined surface 94 of flashing 90 therein. As before, any appropriate sealant may be use.

In general to those skilled in the art to which this invention relates many changes in construction and widely differing embodiments and applications of the present invention will suggest themselves without departing from its spirit and scope. For example, the cross-sectional shape of the outer seal member may be other than the arch-shape described above such as an inverted V-shape or the like. Likewise, the cross-sectional shape of the gutter may be other than the inverted arch-shape described such as a V-shape or the like. Thus, the disclosures and descriptions herein are purely illustrative, and are not intended to be in any sense limiting.

What is claimed is:

1. A weather seal of the type used to seal an expandable joint between adjacent building sections secured to the building sections with the aid of a clamping bar or beam comprising:

an elastomeric outer seal;

first receiving means in said elastomeric outer seal for receiving a portion of said building sections;

second receiving means in said elastomeric outer seal for receiving a clamping bar; and third receiving means in said elastomeric outer seal for receiving applied continuous sealant material.

2. The weather seal according to claim 1, wherein said first receiving means in said elastomeric outer seal includes a region for receiving building flashing.

3. The weather seal according to claim 1, further comprising an inner seal disposed in said joint between said building sections said inner seal securingly engaging said elastomeric outer seal.

4. The weather seal according to claim 1, further comprising retaining means for securing to said outer seal insulation/support material between said elastomeric outer seal and said joint said retaining means securingly engaging said elastomeric outer seal.

5. The weather seal according to claim 4, wherein said retaining means are integrally formed in said elastomeric outer seal.

6. The weather seal according to claim 1, further comprising insulation/support material secured to said elastomeric outer seal between said elastomeric outer seal and said joint between adjacent building sections.

7. A weather seal of the type used to seal an expandable joint between adjacent building sections from the external environment the weather seal being secured to the building sections by flashing material having first and second retaining clip portions adapted to be disposed in notched recesses in the weather seal, comprising:

an elastomeric outer seal;

first receiving means located at a lateral edge of said outer seal having a notched recess for receiving a first retaining clip portion of the flashing;

second receiving means located at a lateral edge of said outer seal having a notched recess for receiving a second retaining clip portion of the flashing; and flap means secured to a lateral edge of said outer seal which overlays said first and second receiving means for isolating the joint from the external environment.

8. The weather seal according to claim 7, further comprising an inner seal disposed in said joint between said building sections said inner seal securingly engaging said elastomeric outer seal.

9. The weather seal according to claim 7, further comprising retaining means for securing to said outer seal insulation/support material between said elastomeric outer seal and said joint, said retaining means securingly engaging said elastomeric outer seal.

10. The weather seal according to claim 9, wherein said retaining means are integrally formed in said elastomeric outer seal.

11. The weather seal according to claim 7, further comprising insulation/support material secured to said elastomeric outer seal between said elastomeric outer seal and said joint between adjacent building sections.

12. A weather seal of the type used to seal an expandable joint between adjacent building sections secured to the building sections with the aid of a clamping bar or beam, comprising:

an elastomeric outer seal;

first receiving means in said elastomeric outer seal for receiving a portion of said building section;

second receiving means in said elastomeric outer seal for receiving a clamping bar;

third receiving means in said elastomeric outer seal for receiving applied continuous sealant material;

an inner seal disposed in said joint between said building sections and securingly engaging said elastomeric outer seal; and retaining means for securing to said outer seal insulation/support material between said elastomeric outer seal and said joint said retaining means securingly engaging said elastomeric outer seal.

13. The weather seal according to claim 12 wherein said retaining means are integrally formed in said elastomeric outer seal.

14. The weather seal according to claim 12 wherein said retaining means comprise L-shaped web members.

15. A weather seal of the type used to seal an expandable joint between adjacent building sections secured to the building sections with the aid of a clamping bar or beam, comprising:

an elastomeric outer seal;

first receiving means in said elastomeric outer seal for receiving a portion of said building section;

second receiving means in said elastomeric outer seal for receiving a clamping bar;

third receiving means in said elastomeric outer seal for receiving applied continuous sealant material; and insulation/support material securingly attached to said elastomeric outer seal between said elastomeric outer seal and said joint.

16. The weather seal according to claim 15 further comprising an inner seal disposed in said joint between said building sections said inner seal securingly engaging said elastomeric outer seal.

17. A weather seal of the type used to seal an expandable joint between adjacent building sections, secured to the building sections with the aid of a clamping bar or beam, comprising:

an elastomeric outer seal;

first receiving means in said elastomeric outer seal for receiving a portion of said building section;

second receiving means in said elastomeric outer seal for receiving a clamping bar;

third receiving means in said elastomeric outer seal for receiving applied continuous sealant material;

insulation/support material securingly attached to said elastomeric outer seal between said elastomeric outer seal and said joint: and an inner seal disposed in said joint between said building sections said inner seal securingly engaging said elastomeric outer seal.

* * * * *

UNITED STATES PATENT AND TRADEMARK OFFICE

CERTIFICATE OF CORRECTION

PATENT NO. : 4,882,890

DATED : November 28, 1989

INVENTOR(S) : Michael C. Rizza

It is certified that error appears in the above—identified patent and that said Letters Patent is hereby corrected as shown below:

On the title page, in section [54], please cancel the word "OPTICAL" and substitute therefor --OPTIONAL--.

Signed and Sealed this

Sixteenth Day of October, 1990

*Attest:*

HARRY F. MANBECK, JR.

*Attesting Officer*

*Commissioner of Patents and Trademarks*